US005918518A

United States Patent [19]

Kobayashi et al.

[11] Patent Number: 5,918,518

[45] Date of Patent: Jul. 6, 1999

[54] APPARATUS AND METHOD FOR CUTTING WEB

[75] Inventors: Hideo Kobayashi, Ichigai-machi, Japan; Manish Sharma, Weymouth, Mass.

[73] Assignee: Kao Corporation, Tokyo, Japan

[21] Appl. No.: 08/777,203

[22] Filed: Dec. 27, 1996

[30] Foreign Application Priority Data

Dec. 28, 1995 [JP] Japan ..... 7-352228

[51] Int. Cl.[6] ..... B26D 7/06; B26D 1/12

[52] U.S. Cl. ..... 83/402; 83/98; 83/100; 83/177; 83/672

[58] Field of Search ..... 83/177, 672, 680, 83/98, 99, 100, 402

[56] References Cited

U.S. PATENT DOCUMENTS

| | | | |
|---|---|---|---|
| 2,224,668 | 12/1940 | Christian | 83/672 |
| 2,265,649 | 12/1941 | Krehbiel | 83/672 |
| 3,698,271 | 10/1972 | Kesten et al. | 83/99 |
| 3,728,918 | 4/1973 | Helm | 83/98 |
| 3,822,625 | 7/1974 | Obenshain | 83/672 |
| 4,041,816 | 8/1977 | Shearon | 83/100 |
| 4,080,856 | 3/1978 | Shearon | 83/100 |
| 4,530,265 | 7/1985 | Lee et al. . | |
| 4,823,659 | 4/1989 | Falasconi | 83/100 |
| 5,109,741 | 5/1992 | Fuchs | 83/100 |
| 5,140,880 | 8/1992 | Littleton | 83/100 |
| 5,419,224 | 5/1995 | Gamperling et al. | 83/98 |
| 5,609,084 | 3/1997 | Gronbjerg | 83/98 |

*Primary Examiner*—M. Rachuba
*Assistant Examiner*—Sean A. Pryor
*Attorney, Agent, or Firm*—Oblon, Spivak, McClelland, Maier & Neustadt, P.C.

[57] ABSTRACT

An apparatus for cutting a web with a rotary cutter 31 includes a cutter drum 42, which has an air suction chamber 58 and air discharge chambers 59A and 59B, these chambers being formed in its inside, as well is having first air jet holes 71, second air jet holes 72, and third air jet holes 73, these air jet holes 71 to 73 being open in its outer periphery.

4 Claims, 10 Drawing Sheets

APPARATUS AND METHOD FOR CUTTING WEB

FIELD OF THE INVENTION

The present invention relates to an apparatus and a method for cutting webs, such as plastic films, metal foils and paper sheets.

Discussion of the Background Art

In the prior art, web take-up apparatuses use web cutters which cut a web wound on a core with a rotary cutter.

These prior art web cutters, however, have the following problems (1) to (4).

(1) In a pre-cutting stage with a rotary cutter held stationary in a stand-by position ready for cutting, a web which is proceeding from the side of a new take-up core and around a cutter drum of the rotary cutter end is being taken up on in old take-up core, may rub the surface of the cutter drum, thus causing scars and scratches in it or its breakage and also dust generation.

(2) With the web merely passed around the cutter drum in the cutting stage, in which rotation of the rotary cutter is caused, it is difficult to provide sufficient tension and necessary shearing force to the cutting portion of the web engaged by a cutter knife. In this case, it is therefore difficult to permit steady cutting.

(3) When the knife is pushed against the core via the web in the cutting stage, it causes scars and scratches on the core, thus causing dust generation and also transfer of the scars and scratches formed on the core to the web.

(4) In the cutting stage or a post-cutting stage, (a) the leading end portion of the web having been cut on the take-up core may be carried with the cutter drum and fail to be taken up on the take-up core, or (b) the trailing end portion of the web may be carried along with the cutter drum and fail to smoothly proceed toward the old take-up core.

SUMMARY OF THE INVENTION

An object of the present invention is to prevent the web from rubbing the cutter drum surface before cutting, ensure steady cutting of the web and prevent disturbance of the cut ends of the web when or after the web is cut.

Another object of the present invention is to prevent formation of scars and scratches on the core by the knife when the web is cut.

According to a feature of the invention, in an apparatus for cutting a web from a take-up core, comprising a rotary cutter positionable adjacent the take-up core, the rotary cutter includes a stationary shaft; a cutter drum mounted for rotation about the stationary shaft; means mounted to said stationary shaft for forming a gas suction chamber within said cutter drum and for respectively forming inlet and outlet gas discharge chambers supplying a gas at a positive pressure at upstream and downstream sides of said gas suction chamber in a direction of rotation of the cutter drum; and a knife mounted to an outer periphery of the cutter drum. An outer periphery of the cutter drum comprises first gas jet holes positioned upstream of the knife in the direction of rotation of the cutter drum, and second gas jet holes upstream of the first gas jet holes in the direction of rotation of the cutter drum. The suction chamber and the inlet and outlet chambers are positioned such that as the cutter drum is rotated so as to rotate said knife and cut a web from the take-up core during a cutting stage, before rotation of said cutter drum to the cutting stage, the second gas jet holes of the cutter drum are communicated with at least one of the web inlet and outlet air discharge chambers, during the cutting state, some of the first gas jet holes of the cutter drum are communicated with the web inlet side air discharge chamber while others of the first gas jet holes are communicated with the gas suction chamber, and during a post-cutting stage, the first gas jet holes of the cutter drum are communicated with the web outlet side gas discharge chamber.

According to another feature of the invention, the cutter drum has third air jet holes open in the outer periphery on the rear side of the knife in the direction of rotation, the third air jet holes of the cutter drum being communicated, in the post-cutting stage, with the web inlet side air discharge chamber, thereby permitting the leading end of the web having been cut on the take-up core to be pressed against the take-up core by air issued from the third air jet holes.

According to another feature of the invention, the cutter drum has a web retainer provided on the outer periphery on the rear side of the knife in the direction of the rotation, the web on the rear side of the knife being pushed, in the cutting state, against the take-up core by the web retainer.

According to another feature of the invention, the web is cut without bringing the knife into forced contact with the take-up core.

According to the invention as set forth in claim 1, functions and effects in (1) to (7) below are obtainable.

(1) In the cutting stage, when the web proceeds from the side of a new take-up core and around the cutter drum of the rotary cutter and is still being taken up on the old take-up core, the web proceeds in a floating condition around the second air jet holes of the cutter drum. Namely, the web does not rub the cutter drum surface, and thus causes no scars or scratches or no dust generation or no breakage of the web.

(2) In the cutting stage in which rotation of the rotary cutter is caused, the web is carried along with the cutter drum in the proximity or in close contact around the first air jet holes of the cutter drum (the close contact being not particularly necessary with a web which is a super-thin film (of 6 $\mu$m or below in thickness) and has a high Young modulus (i.e., 500 kg/mm or above), sufficient tension and necessary shearing force are provided to the cutting portion of the web engaged by the knife, thus permitting steady cutting.

(3) In the cutting stage, the leading end of the web having been cut on the take-up core is pressed against the take-up core by air issuing from the first air jet holes of the cutter drum, thus permitting the leading end of the web to be reliably taken up on the take-up core.

(4) In the post-cutting stage, the trailing web having been cut is separated from the cutter drum by air issued from the first air jet holes of the cutter drum and allowed to proceed reliably to the old take-up core.

(5) In the post-cutting stage, the leading end of the web having been cut on the take-up core is pressed against the take-up core by air issued from the third air jet holes of the cutter drum and can be reliably taken up on the take-up core.

(6) In the state in (2) above, in which the web ahead of the knife is in close contact around the first air jet holes of the cutter drum, the web behind the knife is pushed against the take-up core by the web retainer. The portion of the web in contact with the knife is thus protruded to cause tension concentration in it and permit steady cutting.

(7) In the cutting stage, since the knife is not brought into forced contact with the take-up core, no scars or scratches are caused on the core. For this reason, it is possible to prevent dust generation or transfer of any scars or scratches from the core to the web.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings.

DESCRIPTION OF THE PREFERRED EMBODIMENT (Take-up assembly) (FIGS. 7 to 10)

Figure 9:
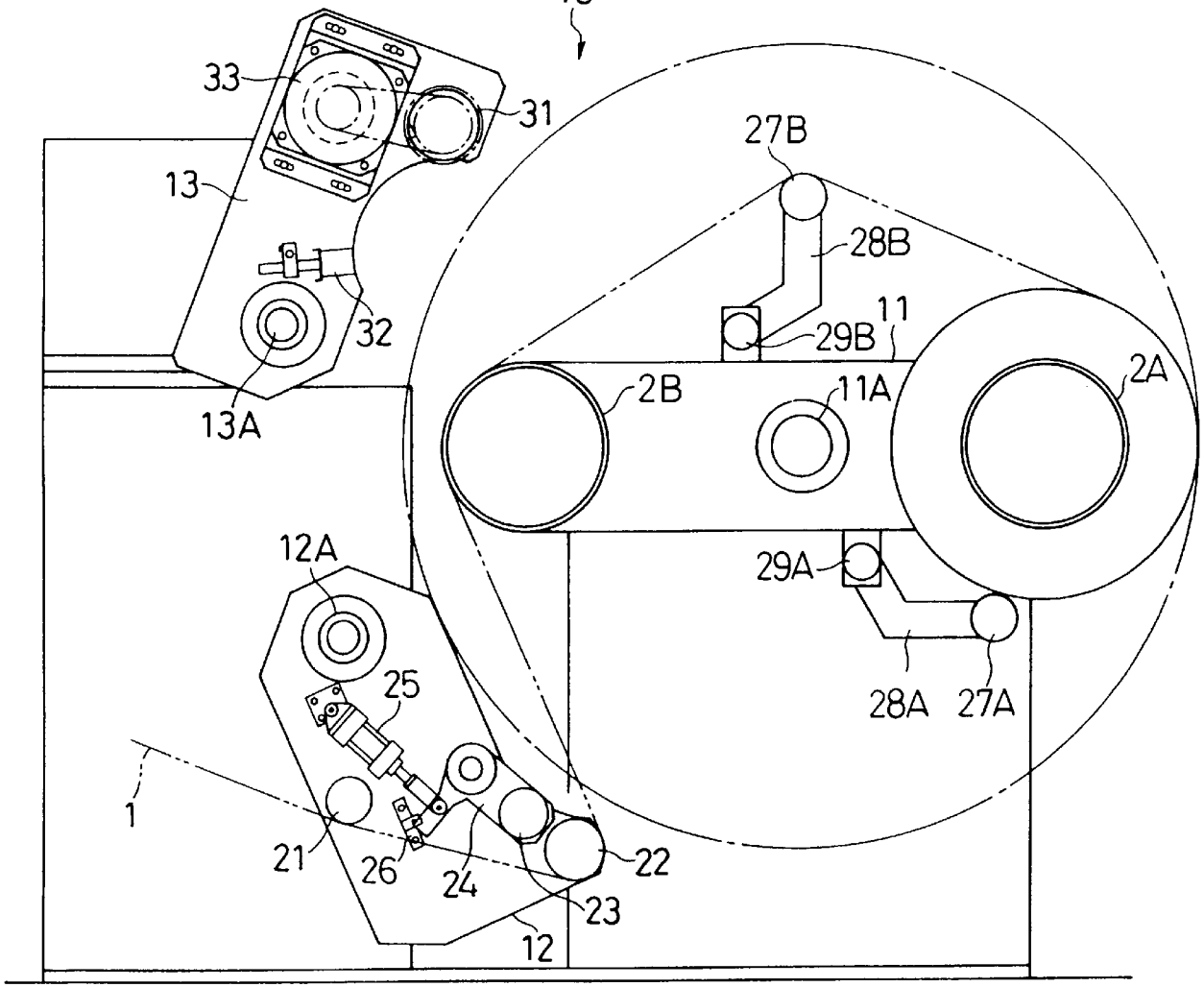
FIG. 9 is a schematic view showing the take-up assembly after the switching of the new and old take-up cores.
Figure 10:
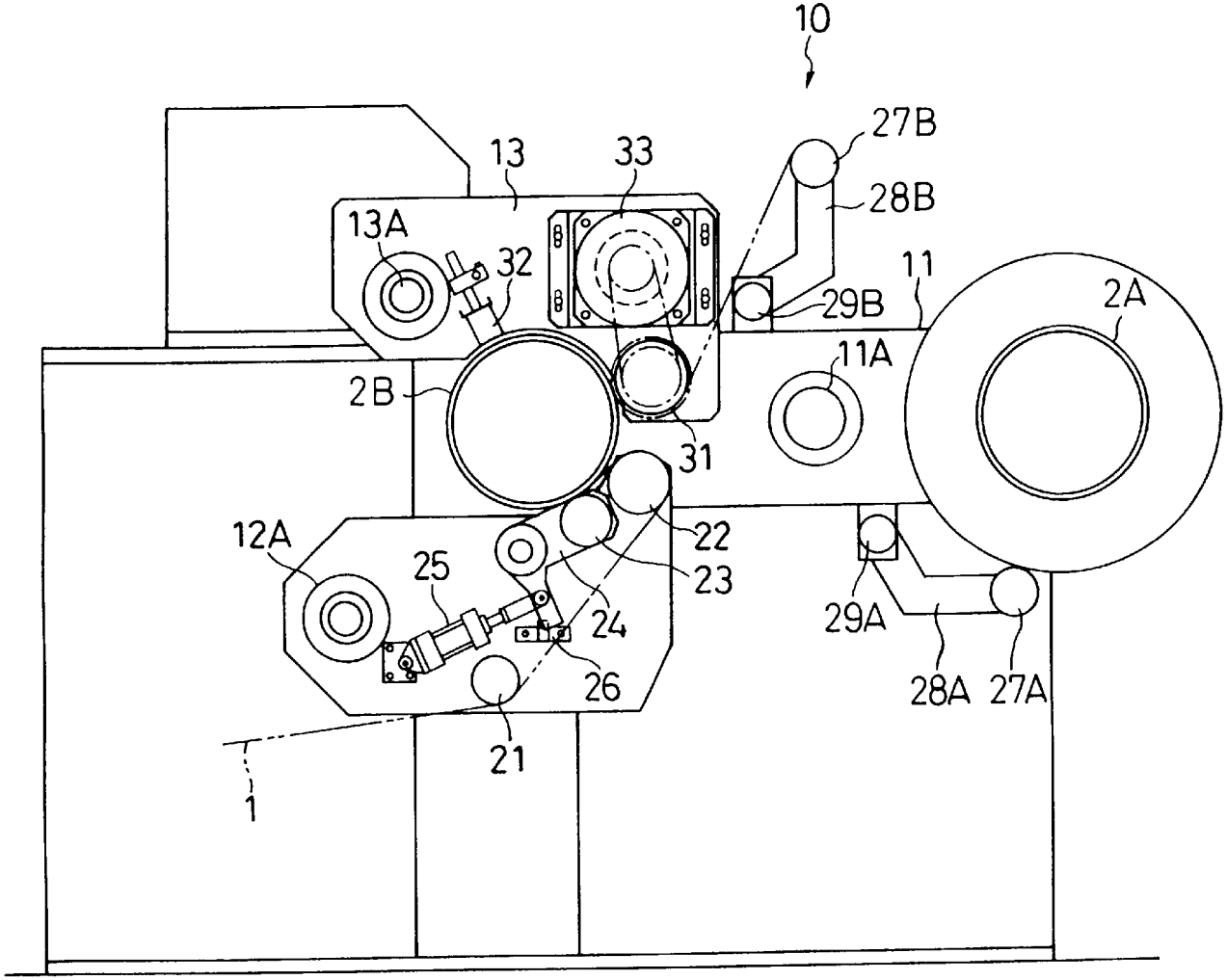
FIG. 10 is a schematic view showing the take-up assembly when starting the take-up on the new take-up core.

A take-up assembly 10 takes up a predetermined length of a web 1 paid off a web roll (not shown) on a take-up core 2. The take-up assembly 10 has two take-up cores 2A and 2B provided on opposite ends (at a take-up position and an post-take-up position) of a rotary arm 11. The take-up cores 2A and 2B are mounted on take-up shafts which are driven by a take-up motor. When a predetermined amount of web 1 has been taken up on the old take-up core 2A which is firstly set at the take-up position (FIG. 7), 180-degree rotation of the rotary arm 11 in a clockwise direction is made to set the old take-up core 2A in the post-take-up position and the new take-up core 2B in the take-up position (FIGS. 9 and 10). Then, the web 1 is cut the new take-up core 2B, and the take-up on the old take-up core 2A is completed, while starting the take-up on the new take-up core 2B (FIG. 10). In the above way, the web 1 paid off the web roll is taken up continuously on the old take-up core 2A and subsequently on the new take-up core 2B. The old take-up core 2A, which has completed the taken-up, is taken out from the rotary arm 11, and in place of the old take-up core 2A a further take-up core (not shown) is set on the rotary arm 11. The rotary arm 11 is rotated by a rotary arm drive motor 11A.

A rider arm 12 and a cutter arm 13 are disposed around the take-up core 2A. Or 2B set in the take-up position on the rotary arm 11.

The rider arm 12 can be rocked by a rider arm rocking motor 12A between a engaging region and a stand-by position, and it includes two guide rollers 21 and 22 and a engaging roller 23. The rider arm 12 is positioned in the engaging region for taking up the web 1 on the take-up core 2A or 2B which has been set in the take-up position on the rotary arm 11, and is held at the stand-by position when switching the two take-up cores 2A and 2B on opposite ends of the rotary arm 11. The engaging roller 23 is supported on an L-shape lever 24 at an end thereof. When the rider arm 12 is in the engaging region, the engaging roller 23 is held in forced contact with the web 1 being taken up around the take-up core 2A or 2B by a pressure applied to it from a pressure application air cylinder 25, which is coupled to the other end of the lever 24, thus preventing air from being trapped in the taken-up web 1. The rider arm 12 has a take-up sensor 26 (e,g. such as an approach switch,) which detects the lever 24 of the engaging roller 23 moving beyond a predetermined extent owing to the roller diameter increase of the web 1 on the take-up core 2A or 2B, from the displacement of the other end of the lever 24. Whenever the take-up sensor 26 detects a predetermined roller diameter increase of the web 1, the rider arm rocking motor 12A is turned on. Thus, the rider arm 12 is repeatedly caused to rock outwardly by a small rocking angle in the engaging region.

The rotary arm 11 in the take-up assembly 10 has cross rollers 27A and 27B mounted thereon for the take-up cores 2A and 2B, respectively. As described before, when the new and old take-up cores 2A and 2B on opposite ends of the rotary arm 11 are switched, the rider arm 12 is held in the stand-by position. Accordingly, when the engaging roller 23 on the rider arm 12 is separated from the web 1 around the old take-up core 2A with the completed taken-up web roll thereon, rocking of the cross arm 28A is caused by a motor 29A to bring the cross roller 27A into forced contact with the web 1 around the take-up core 2A and prevent air from being trapped in the web 1 during subsequent rotation of the rotary arm 11. When the engaging roller 23 on the rider arm 12 is later separated from the web 1 around the take-up core 2B with the newly completed taken-up web roll thereon, rocking of the cross arm 28B is caused by a motor 29B to bring the cross roller 27B into forced contact with the web 1 around the take-up core 2B and prevent air from being trapped in the web 1.

The cutter arm 13 can be advanced and retreated by a cutter arm advancement/retreat drive (not shown). In the advanced position, the cutter arm 13 can be rocked by a cutter arm rocking motor 13A between a cutting position and a stand-by position. The cutter arm 13 includes a rotary cutter 31 and a charger 32. After the old take-up core 2A and the new one 2B on opposite ends of the rotary arm 11 have been switched to bring the take-up core 2A with the completed taken-up web roll therein to the post-take-up position and bring the take-up core 2B for starting the take-up thereon to the take-up position, the cutter arm 13 is set in the cutting position, and the web 1 extending between the new take-up core 2B and the old take-up core 2A is cut around the new take-up core 2B by the rotary cutter 31 rotated by a motor 33. Right before the cutting of the web 1 by the rotary cutter 31, the charger 32 is turned on to charge the web 1 around the new take-up core 2B for holding the trailing end of the cut web 1 in close contact around the new take-up core 2B. The charger 32 is turned off right after the cutting of the web 1.

Operations in the take-up assembly 10 are as follows.

Figure 7:
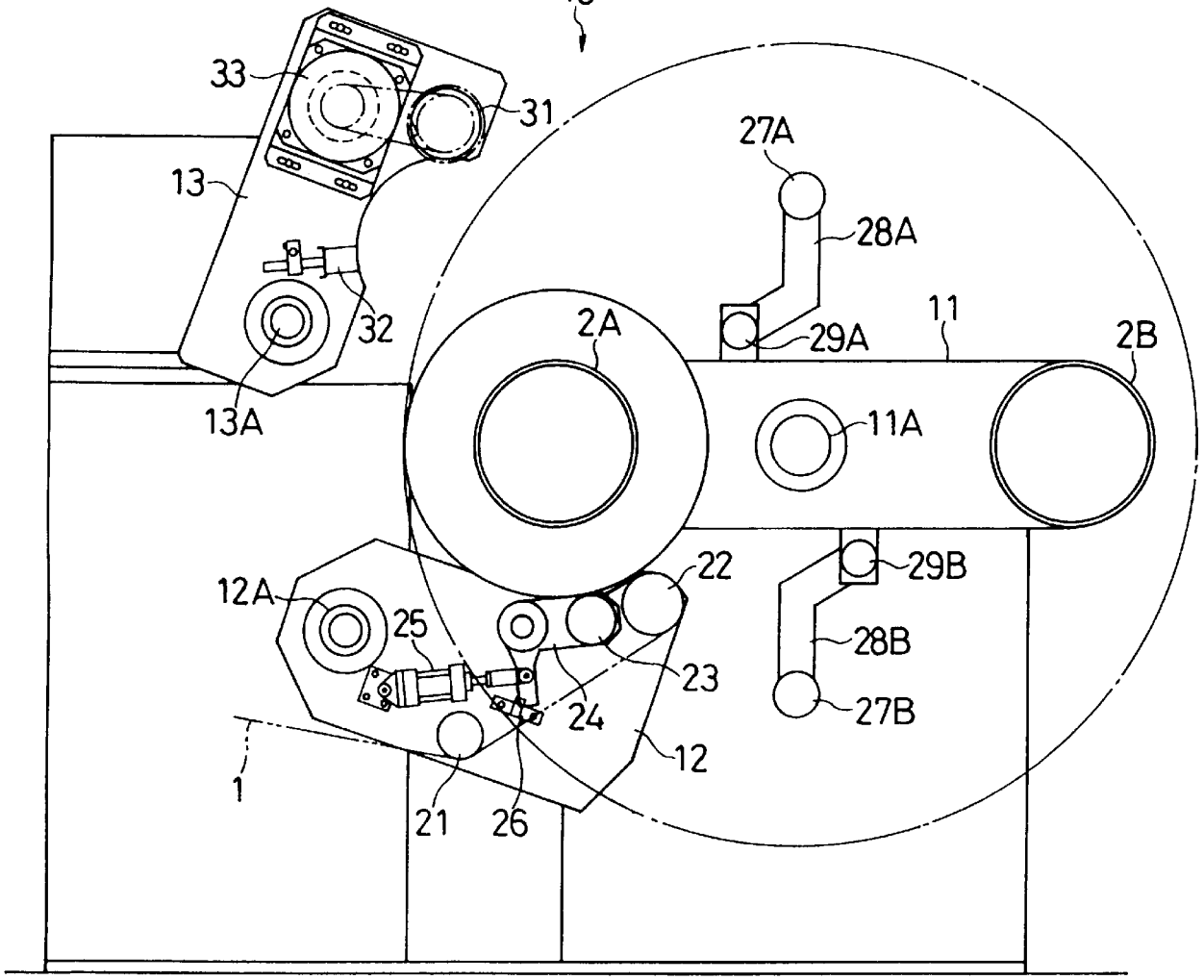
FIG. 7 is a schematic view showing a take-up assembly when take-up on an old take-up core has been ended.
Figure 8:
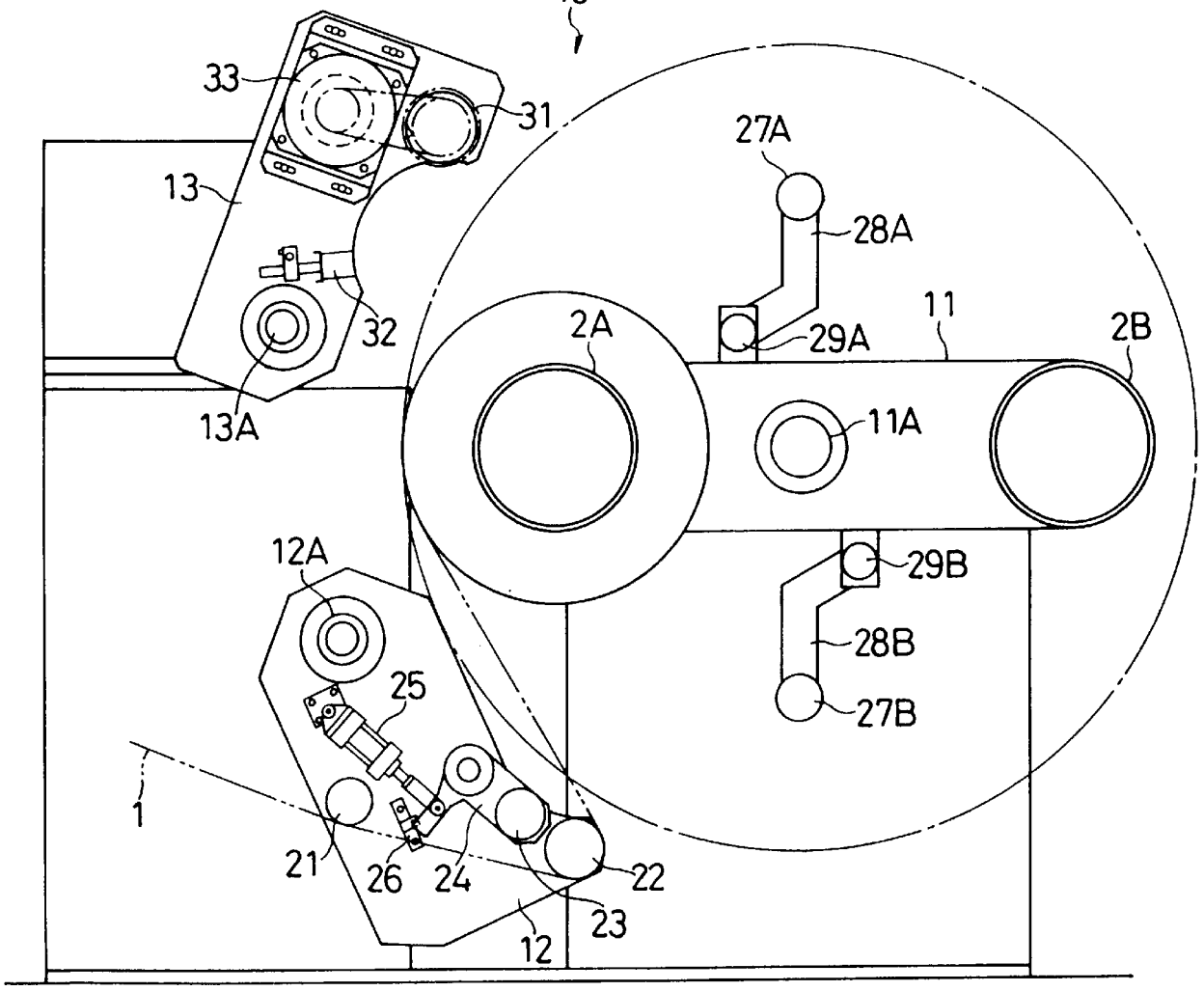
FIG. 8 is a schematic view showing the take-up assembly before the switching of new and old take-up cores.

(1) The web 1 paid off the web roll is taken up on the take-up core 2A. In this stage of operation, the rider arm 12 is positioned in the engaging region (FIG. 7).

(2) When a predetermined amount of web 1 has been taken up on the take-up core 2A, the cross roller 27A is brought into forced contact with the web 1 around the take-up core 2A. The rider arm 12 is then brought to the stand-by position. Then, 180-degree rotation of the rotary arm 11 is caused to bring the old take-up core 2A to the post-take-up position while bringing the new take-up core 2B to the take-up position (FIG. 9).

(3) The cutter arm 13 is advanced and then brought to the cutting position, and the rider arm 12 is positioned in the engaging region (FIG. 10).

(4) The web 1 is cut by the rotary cutter 31 of the cutter arm 13, and then the cutter arm 13 is brought back to the stand-by position. The take-up of the web 1 on the new take-up core 2B is then started.

The rotary cutter 31 will now be described in detail.

(Rotary cutter) (FIGS. 1 to 6).

As shown in FIGS. 1 to 6, the rotary cutter 31 includes a stationary shaft 41 and a cutter drum 42 which can be rotated about the stationary shaft 41.

The stationary shaft 41 is supported on a frame 43 via a tension pick-up 44 and a bearing 45 so as to be capable of adjusting its position in the direction of rotation and is appendantly (collaterally) provided with a lock mechanism 46 for locking against rotation after adjusting the rotational direction position.

The cutter drum 42 is rotatably supported on the stationary shaft 41 via bearings 47, 47. The cutter drum 42 has a timing pulley 48 secured to it, and can be rotated intermittently by a motor 33 which can be a servomotor, supported on the frame 43 via a timing belt 51, which is passed around a timing pulley 50 secured to the servo motor 33 and the timing pulley 48.

Figure 5:
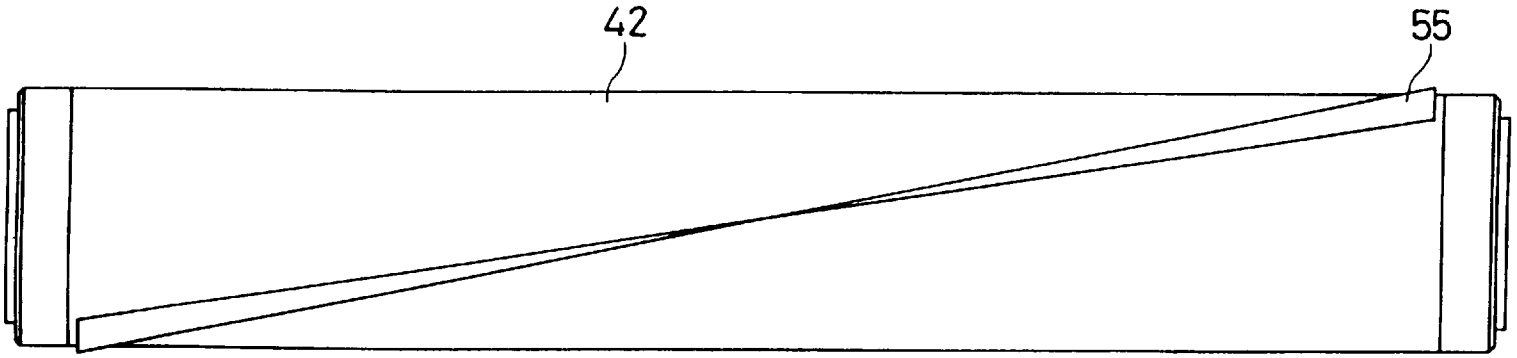
FIG. 5 is a schematic view showing of the web cutting apparatus, with the manner of mounting a knife of the cutting apparatus.
Figure 5B:
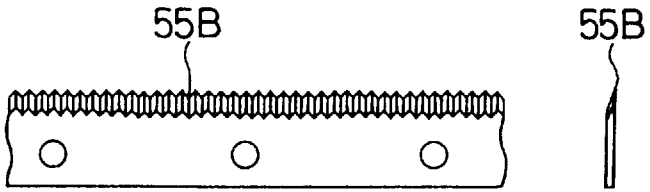
FIG. 5B shows a knife having a sawtooth blade.
Figure 5A:
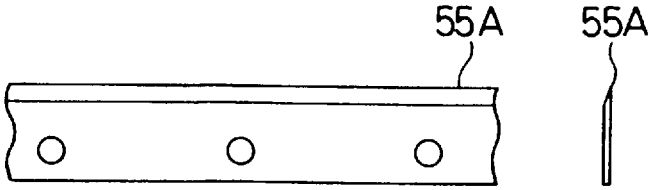
FIG. 5A shows a knife having a straight blade.
Figure 6:
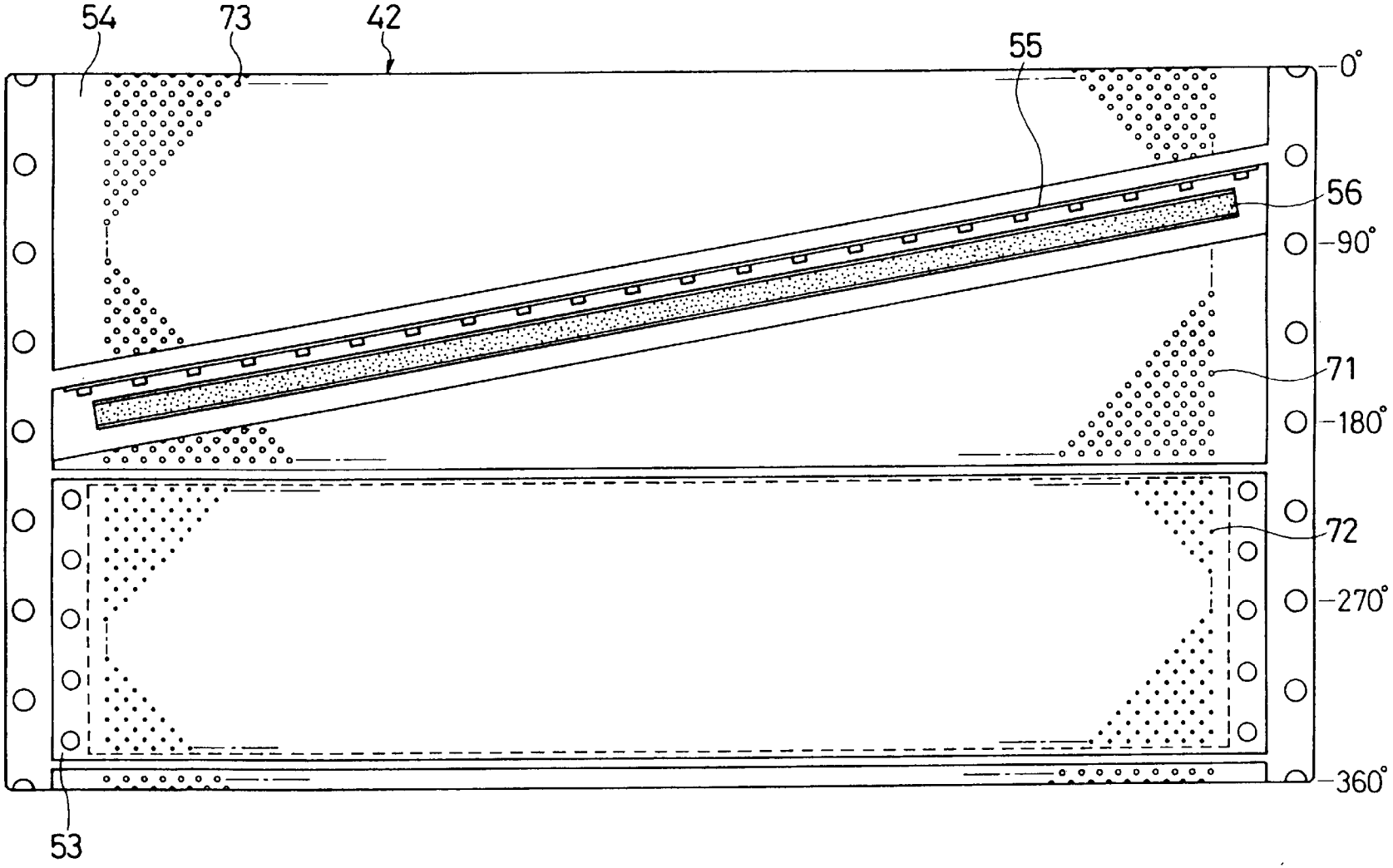
FIG. 6 is a schematic developed view showing a cutter drum of the web cutting apparatus.

The cutter drum 42 includes a drum body 52, a metal shell 53 provided on a part of the outer periphery of the drum body 52, and a rubber shell 54 provided on the remainder of the outer periphery. As shown in FIGS. 5 and 6, the cutter drum 42 has a knife 55, which is mounted helically on the portion between the rubber shell 54 on one side of the outer periphery of the drum body 52 and the rubber shell 54 on the other side thereof. The knife 55 may be a straight blade 55A as shown in FIG. 5A, or it may be a sawtooth blade 55B as shown in FIG. 5B. Usually the sawtooth blade 55B is adopted, but where the web is a super-thin film, the straight blade 55A is effectively adopted.

The rotary cutter 31 further has a web retainer 56 made of sponge or like material, which is mounted on the outer periphery behind or downstream of the knife 55 in the direction of rotation of the cutter drum 42. The web retainer 56 is helically mounted along the knife 55. When the web 1 is cut, the web retainer 56 can push a portion of the web 1 on the rear side of the knife 55 against the take-up core 2.

The rotary cutter 31 further has four partitioning members 57 helically provided along the knife 55 and mounted around the stationary shaft 41 in the cutter drum 42. These partitioning members 57 define an air suction chamber 58, an inlet side air discharge chamber 59A on the web inlet side of the air suction chamber 58 and an outlet side air discharge chamber 59B on the web outlet side of the air suction chamber 58 around the stationary shaft 41. An air suction passage 61A formed in the stationary shaft 41 and an air joint 61B are connected to the air suction chamber 58. An air joint 62A, an air tube 62B, an air joint 62C, an air discharge passage 62D formed in the stationary shaft 41 and an air joint 62E are connected the inlet side air discharge chamber 59A. An air joint 63A, an air tube and an air joint (not shown), an air discharge passage 63D formed in the stationary shaft 41 and an air joint 63B are connected to the outlet side air discharge chamber 59B.

The rotary cutter 31 further has the following structures (a) to (c).

(a) The cutter drum 42 has first air jet holes 71 open in its outer periphery on the front or upstream side of the knife 55 in the direction of its rotation. The first air jet holes 71 penetrate the drum body 52 and the rubber shell 54 of the cutter drum 42.

(b) The cutter drum 42 has second air jet holes 72 open in its outer periphery on the front or upstream side of the first air jet holes 71 in the direction of its rotation. The second air jet holes 72 are open in the outer periphery of the metal shell 53 of the cutter drum 42, and are communicated with the inner space of the cutter drum 42 through communication holes 72B formed in the drum body 52 on the opposite sides of a buffer chamber 72A provided on the inner side of the metal shell 53.

(c) The cutter drum 42 has third air jet holes 73 open in its outer periphery on the rear or downstream side of the knife 55 in the direction of its rotation. The third air jet holes 73 penetrate the drum body 52 and the rubber shell 54 of the cutter drum 42.

Operations of the rotary cutter 31 will be described hereinunder.

The speed V2 of rotation of the cutter drum 42 of the rotary cutter 31 caused by the motor 33 varies in dependence on the thickness or material of the web 1, but it is set to be slightly higher than the speed V1 of tile take-up core 2 (web 1) in order to provide sufficient tension in the web 1. The web 1 will be cut without bringing the knife 55 into forced contact with the take-up core 2. However, the knife 55 and the take-up core 2 are desirably brought to be as close to each other as possible without bringing them into contact. For example, where the thickness of the web 1 is 10 $\mu$m or below, a clearance of 0.2 mm is provided between the knife 55 and the take-up core 2.

Figure 1:
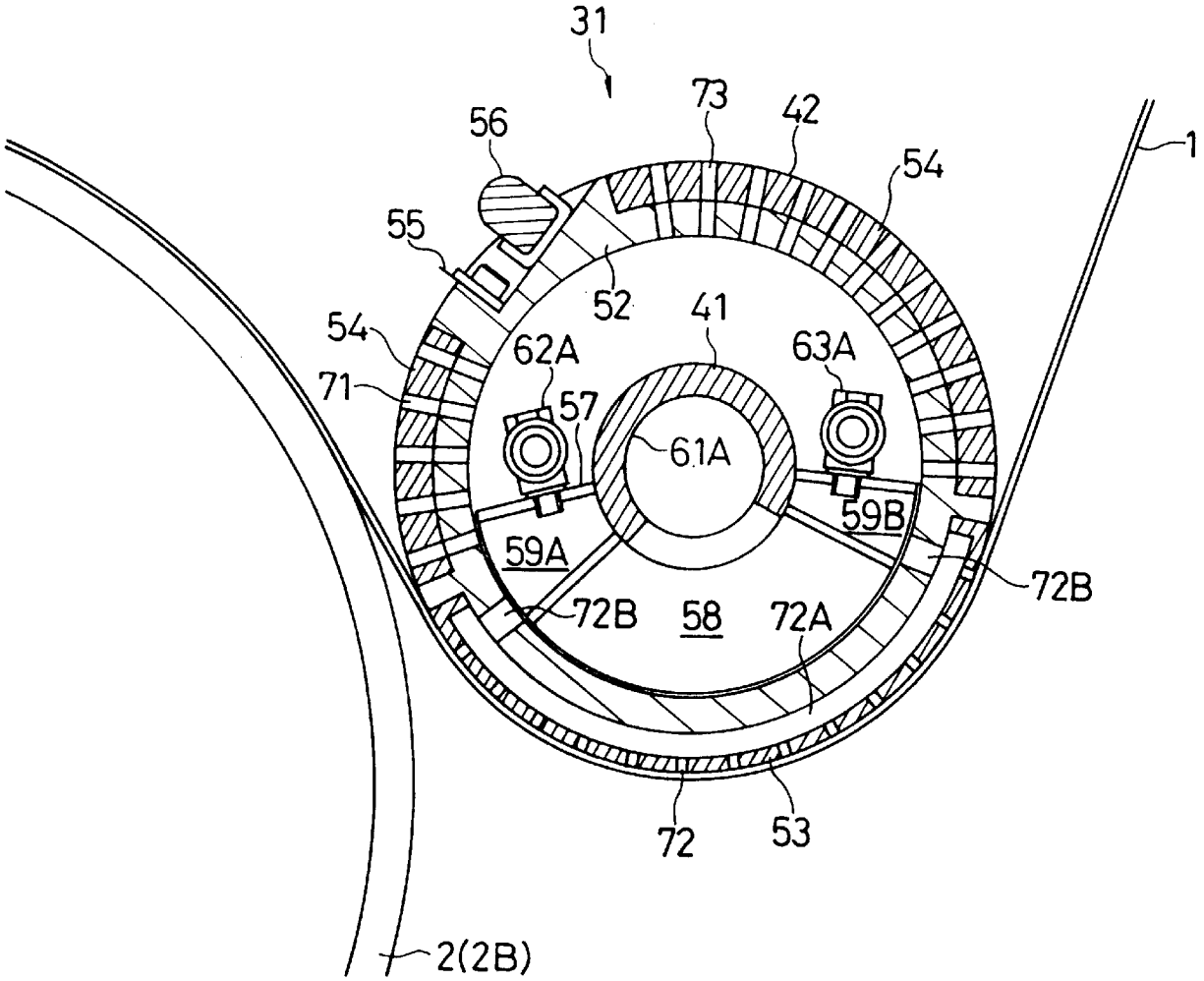
FIG. 1 is a schematic view showing a web cutting apparatus according to the present invention in a pre-cutting stage.

(1) Pre-cutting stage (FIG. 1)

The cutter drum 42 is held in the stand-by position as shown in FIG. 1. In this state, the second air jet holes 72 of the cutter drum 42 are in communication with the inlet side air discharge chamber 59A and the outlet side air discharge chamber 59B. The pressure of air which is thus blown out from the second air jet holes 72 in the outer periphery of the metal shell 53, is applied to the web 1 proceeding from the side of the new take-up core 2B around the metal shell 53 of the cutter drum 42 toward the old take-up core 2A. The web 1 thus proceeds around the metal shell 53 in a floating state. To ensure the floating state of the web 1, the surface of the metal shell 53 is desirably as smooth as possible.

Figure 2:
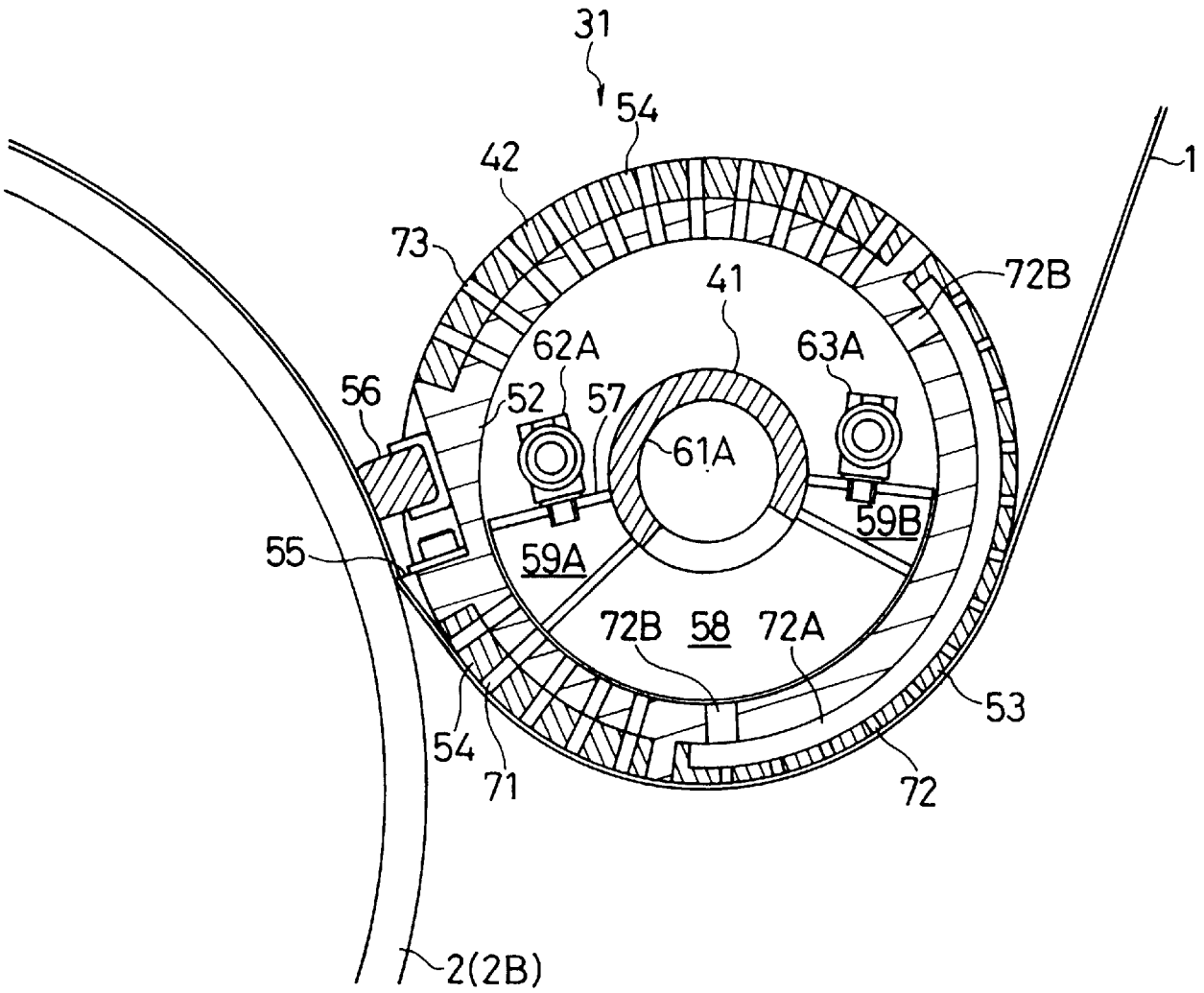
FIG. 2 is a schematic view showing the web cutting apparatus in a cutting stage.

(2) Cutting stage (FIG. 2)

When the cutter drum 42 is rotated, those of the first air jet holes 71 of the cutter drum 42 which are nearer the knife 55 are communicated with the inlet side air discharge chamber 59A, while the other first air jet holes 71 are communicated with the air suction chamber 58. Also, the web 1 is pushed against the take-up core 2 by the web retainer 56. Since the knife 55 is helically mounted on the cutter drum 42, only a portion of the knife 55 is protruded at this time, thus causing concentration of tension in this portion to start cutting of the web 1.

The web 1 is cut by the knife 55 in a state that it is in close contact with tile first air jet holes 71 which are in communication with the air suction chamber 58. The leading end of the web 1 which has thus been cut on the take-up core is pressed against the take-up core 2 by air issued from the first air jet holes 71 in communication with the inlet side air discharge chamber 59A.

The outer periphery of the cutter drum 42 is constituted by the rubber shell 54 except for the portion constituted by the metal shell 53. This is made so for increasing the coefficient of friction of the cutter drum 42 and thus increasing the effect of tension cutting.

Figure 3:
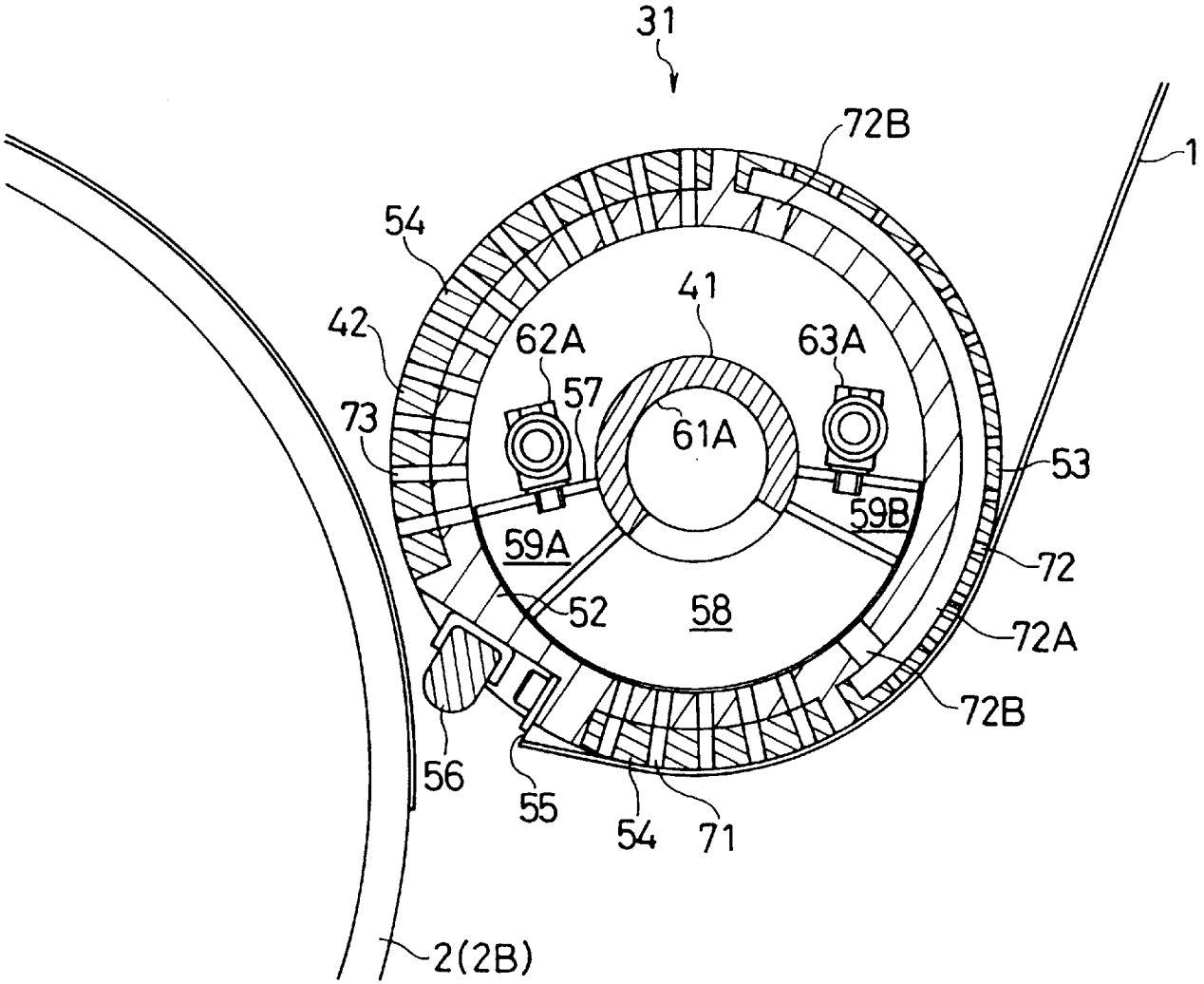
FIG. 3 is a schematic view showing the web cutting apparatus in a post-cutting stage.
Figure 4:
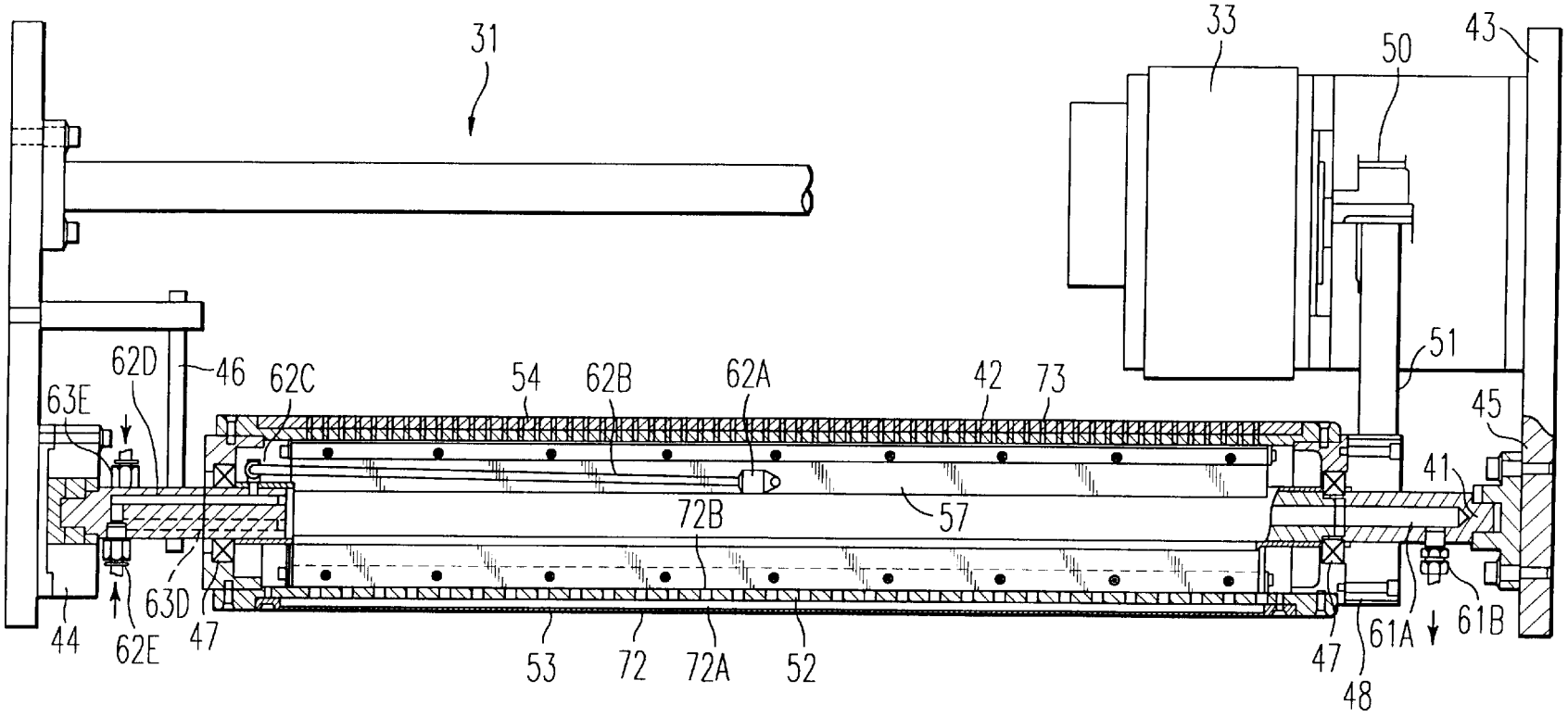
FIG. 4 is a sectional view showing the web cutting apparatus.

(3) Post-cutting stage (FIG. 3)

With further rotation of the cutter drum 42, the first air jet holes 71 are eventually communicated with the outlet side air discharge chamber 59B. The trailing end of the web 1 having been cut is thus separated from the cutter drum 42 by air issued from the first air jet holes 71.

Similarly, as the cutter drum rotates, the third air jet holes 73 are communicated with the inlet side air discharge chamber 59A. Thus, the leading end of the web 1 having been cut on the take-up core 2 is pressed against the take-up core 2 by air issued from the third air jet holes 73.

With this embodiment, the following functions and beneficial effects are obtainable.

(1) When the rotary cutter 31 is stationary in the stand-by position and ready for cutting the web 1, the web 1 which is still proceeding from the side of the new take-up core 2 around the cutter drum 42 of the rotary cutter 31 and being taken up on the old take-up core 2, passes around the second air jet holes 72 of the cutter drum 42 in a floating state. That is, the web 1 does not rub the surface of the cutter drum 42, thus causing no slip flaws or breakage or dust generation of the web 1.

(2) When cutting the web 1 with the rotation of the rotary cutter 31, the web 1 is carried along with the cutter drum 42 in close contact with the first air jet holes 71 thereof, and sufficient tension and necessary shearing force are provided to the cutting portion of the web 1 engaged by the knife 55. Steady cutting is thus permitted.

(3) In the cutting stage, the leading end of the web 1 having been cut on the take-up core 2 is pressed against the take-up core 2 by air issued from the first air jet holes 71 of the cutter drum 42, so that it can be reliably taken up on the take-up core 2.

(4) In the post-cutting stage, the trailing end of the web 1 having been cut is separated from the cutter drum 42 by air issued from the first air jet holes 71 of the cutter drum 42, and the trailing end of the web 1 is thus reliably caused to proceed toward the old take-up core 2.

(5) In the post-cutting stage, the leading end of the web 1 having been cut on the take-up core 2 is pressed against the take-up core 2 by air issued form the third air jet holes 73 of the cutter drum 42, thus permitting the leading end of the web 1 to be taken up reliably on the take-up core 2.

(6) In the state that the web 1 ahead of the knife 55 is in close contact with the first air jet holes 71 of the cutter drum 42 as described in (2) above, the web 1 behind the knife 55 is pressed against the take-up core 2 by the web retainer 56. Thus, the cutting portion of the web 1 engaged by the knife 55 is protruded, and tension is concentrated in this portion. Steady cutting is this permitted.

(7) In the cutting stage, the knife 55 is not brought into forced contact with the take-up core 2 and does not cause any scars or scratches thereto. Without any scars or scratches caused to the take-up core by the knife 55, it is possible to eliminate dust generation or transfer of any scars or scratches from the take-up core to the web 1.

In the cutting stage, the web tension can be detected by the tension pick-up 44 in the rotary cutter 31 and adjusted according to the result of the detection. Instead of the rotary cutter 31, the tension pick-up 44 may be provided on a different part such as a guide roller.

While the preferred embodiment of the invention has been described in the foregoing with reference to the drawings, the specific constructions of the embodiment as described above are by no means limitative, and changes and modifications in the details of the design may be made without departing from the scope of the invention.

As has been described, according to the invention it is possible to prevent the web from rubbing the cutter drum surface in the pre-cutting stage, permit steady cutting in the cutting stage and prevent disturbance of cut ends of the web in the cutting stage or post-cutting stage.

Besides, according to the invention it is possible to eliminate any flaw caused to the core by the knife in the cutting stage.

While the preferred embodiments of the invention have been described in detail with reference to the drawings, they are by no means limitative, and various changes and modifications are possible without departing from the scope and spirit of the invention.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above but to include all possible embodiments which can be embodied within a scope encompassed and equivalents thereof with respect to the feature set out in the appended claims.

What is claimed as new and is desired to be secured by Letters Patent of the United States is:

1. An apparatus for cutting a web from a take-up core, comprising a rotary cutter positionable adjacent the take-up core, the rotary cutter including:

a stationary shaft;

a cutter drum mounted for rotation about the stationary shaft wherein said cutter drum is configured to rotate between at least a standby position, a cutting position and a post-cutting position;

means mounted to said stationary shaft for forming a gas suction chamber within said cutter drum and for respectively forming inlet and outlet gas discharge chambers supplying a gas at a positive pressure at upstream and downstream sides of said gas suction chamber in a direction of rotation of the cutter drum;

a knife mounted to an outer periphery of the cutter drum, wherein an outer periphery of the cutter drum comprises first gas jet holes positioned upstream of the knife in the direction of rotation of the cutter drum, and second gas jet holes upstream of the first gas jet holes in the direction of rotation of the cutter drum; and wherein said suction chamber and said inlet and outlet chambers are positioned such that;

the second gas jet holes of the cutter drum are communicated with at least one of the web inlet and outlet air discharge chambers when said cutter drum is in the standby position;

a first portion of the first gas jet holes of the cutter drum are communicated with the web inlet side air discharge chamber while a second portion of the first gas jet holes are communicated with the gas suction chamber when said cutter is in the cutting position and the first gas jet holes of the cutter drum are communicated with the web outlet side gas discharge chamber when said cutter drum is in the post cutting position.

2. The web cutting apparatus according to claim 1, wherein the cutter drum has third jet holes at a position downstream of the knife in the direction of rotation, wherein the third gas jet holes of the cutter drum are positioned so as to communicate with the web inlet side gas discharge chamber when the cutter drum is in the post-cutting position.

3. The web cutting apparatus according to claim 1 including a web retainer provided on an outer periphery of the cutter drum at a position downstream of the knife, wherein said web retainer is positioned to push on the take-up core during the cutting stage.

4. The web cutting apparatus according to claim 1 wherein said knife is spirally mounted on said cutter drum.

* * * * *